US006065590A

United States Patent [19]

Spivey

[11] Patent Number: 6,065,590

[45] Date of Patent: May 23, 2000

[54] HANDLED BOTTLE CARRIER

[75] Inventor: Raymond R. Spivey, Mableton, Ga.

[73] Assignee: Riverwood International Corporation, Atlanta, Ga.

[21] Appl. No.: 09/167,616

[22] Filed: Oct. 6, 1998

[51] Int. Cl.[7] ..... B65D 75/00; B65D 5/46

[52] U.S. Cl. ..... 206/141; 206/162; 206/200; 206/427; 229/117.14; 229/117.13

[58] Field of Search ..... 206/141–143, 206/162–165, 168–170, 200, 427, 428; 229/117.12, 117.13, 117.14

[56] References Cited

U.S. PATENT DOCUMENTS

| | | | |
|---|---|---|---|
| 2,681,143 | 6/1954 | Guyer . | |
| 2,842,304 | 7/1958 | Ringler . | |
| 2,955,739 | 10/1960 | Collura . | |
| 3,076,591 | 2/1963 | Nute et al. . | |
| 3,300,119 | 1/1967 | Chaussadas . | |
| 4,378,905 | 4/1983 | Roccaforte . | |
| 4,470,503 | 9/1984 | Stone | 206/428 |
| 4,482,090 | 11/1984 | Milliens . | |
| 4,498,619 | 2/1985 | Roccaforte | 229/117.13 |
| 4,546,914 | 10/1985 | Roccaforte . | |
| 4,588,084 | 5/1986 | Holley, Jr. | 206/427 |
| 4,747,534 | 5/1988 | Marie . | |
| 5,197,598 | 3/1993 | Stout et al. | 206/427 |
| 5,328,081 | 7/1994 | Saulas . | |
| 5,385,234 | 1/1995 | Stout et al. | 206/427 |
| 5,482,203 | 1/1996 | Stout | 229/117.13 |
| 5,639,017 | 6/1997 | Fogle . | |

FOREIGN PATENT DOCUMENTS

| | | |
|---|---|---|
| 2481-231 | 10/1981 | France . |
| 2 206 565 | 1/1989 | United Kingdom . |
| 96/01770 | 1/1996 | WIPO . |
| 96/27538 | 9/1996 | WIPO . |

*Primary Examiner*—M. D. Patterson
*Assistant Examiner*—J. Mohandesi
*Attorney, Agent, or Firm*—Skinner and Associates; Steve M. McLary

[57] ABSTRACT

An article carrier, comprising a first side panel and an opposite second side panel connected to a top panel, a bottom panel, a first end panel, and an opposite second end panel. The top panel is comprised of a first top panel flap foldably connected to the first side panel, and a second top panel flap foldably connected to the second side panel. At least a portion of the first top panel flap overlaps and is adhered to at least a portion of the second top panel flap. Opposing first upper end panel flaps are connected by a fold line to opposite ends of the first top panel flaps, and opposing second upper end panel flaps are connected by a fold line to opposite ends of the second top panel flaps. Means for defining a handle strap is included in the first top panel flap, wherein the handle strap overlies the second top panel flap. The handle strap has opposite ends and spans across the first top panel flap. The handle strap ends are connected to the first upper end panel flaps. The means for defining a handle strap permit the handle strap to be raised above the top panel.

33 Claims, 10 Drawing Sheets

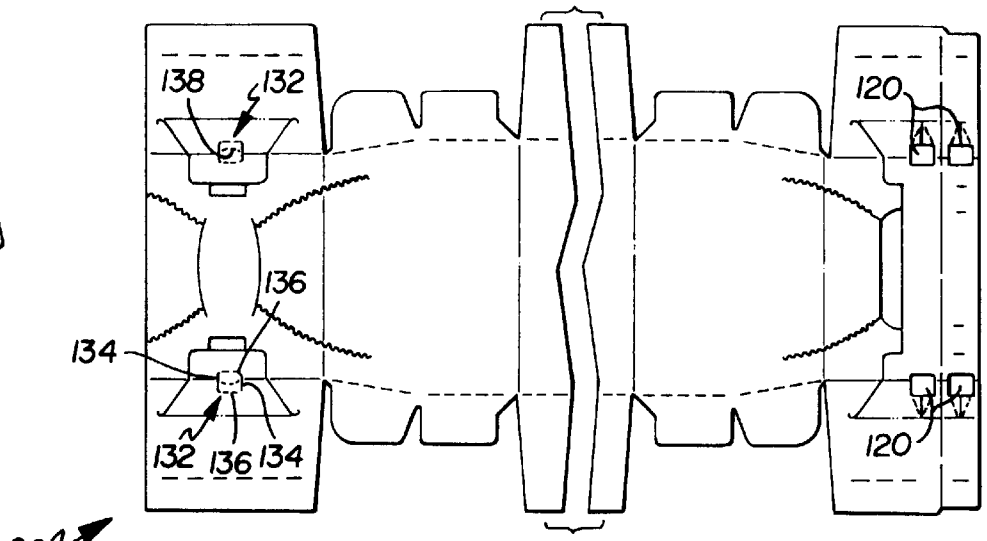
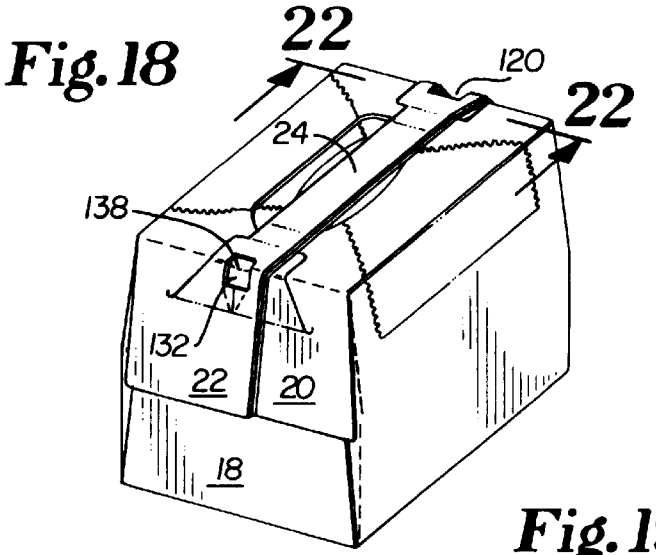
Fig. 18
Fig. 19
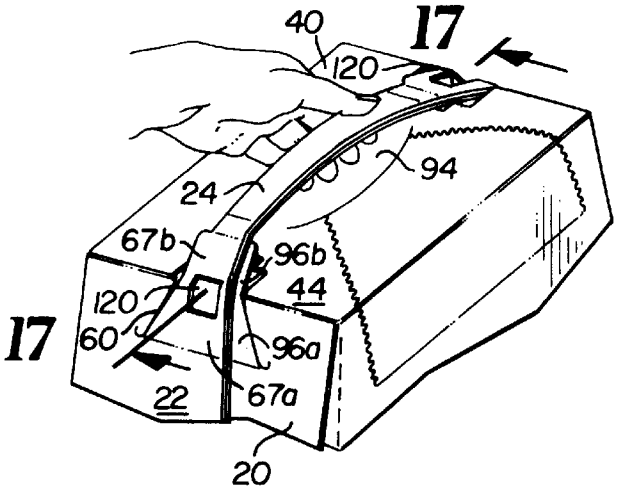
Fig. 16
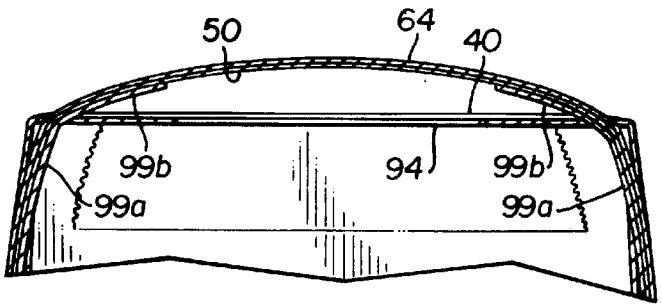
Fig. 17

HANDLED BOTTLE CARRIER

BACKGROUND OF THE INVENTION

1. Field of the Invention

The present invention relates, generally, to article carriers which incorporate integrally formed handles. More particularly, the invention relates to a carrier having an integrally formed handle extending the length of the carrier. The invention has particular utility as a bottle carrier.

2. Background Information

Article carriers are normally provided with a handle for convenient lifting. Although it may take many forms depending on the type of carrier involved, a satisfactory handle should be designed so as to be readily grasped, comfortable to the hand and capable of lifting the carrier without tearing. For carriers containing heavy loads, such as beverage cans or bottles, it is often necessary to reinforce the handle by making it of multi-ply construction. For example, in fully enclosed sleeve-type carriers the top panel is often formed by overlapping top panel flaps located at the ends of a blank. Each flap contains a handle opening arranged so that the top panel of the carrier includes two spaced openings. This arrangement is sometimes referred to as a "suitcase handle" since the strap portion of the top panel between the handle openings is gripped in the manner of a suitcase handle. Although the strap is made stronger by this two-ply construction, lifting stresses are still concentrated within a small area at the ends of the short strap and the edges of the handle openings.

An alternative to the suitcase type of handle is an elongated strap extending from one end panel to the other. This alternative design has the advantage of distributing lifting stresses to the ends of the carrier where they are more readily disseminated with less risk of tearing the carrier. Such an arrangement, however, can introduce other problems. If the handle is formed as an integral part of the top panel, it may separate from the top panel when lifted, leaving an opening in the top panel through which dirt and dust can enter. If the handle is attached as a separate unit the top panel can remain intact but the carrier fabrication process is made more complicated.

Known article carriers are believed to have significant limitations and shortcomings. Applicant's invention provides an article carrier which is believed to constitute an improvement over the known art.

BRIEF SUMMARY OF THE INVENTION

The present invention provides a handled bottle carrier which generally comprises opposing side panels connected to a top panel, a bottom panel and opposing end panels. The top panel is comprised of a first top panel flap that overlaps and is adhered to a second top panel flap. The first top panel flap includes a handle strap and a reinforcement flap folded under and adhered to the handle strap to form a double-ply handle. The handle is capable of being raised above the top panel between the handle ends, which are adhered to the end panels.

When the carrier is lifted by the handle, the adhered handle straps are raised above the first and second top panel flaps. The second top panel flap remains below the handle and prevents fingers and knuckles from contacting the top of the bottles and and becoming abraded. Preferably, the ends of the handle strap extend into the upper end panel flaps that are connected to the top panel flaps. The end panels, side panels, and top panels have slits and scores that allow the carton to conform to the contour of a group of bottles within the carrier.

In one embodiment, the handled bottle carrier further includes notches cut in the end of the handle. The notches engage the top of a bottle and prevent bottles from pivoting and otherwise moving within the carrier. This embodiment of the carrier is particularly useful for relatively heavy and fragile glass bottles.

In another embodiment, the notches cut in the end of the handle retain an opaque panel that is appropriately slit and scored for receiving the top of a bottle. The formed two-ply handle will have a notch cut in the outside ply and the opaque panel in the inside ply directly beneath the notch. The opaque panel blocks sunlight from contacting the bottles, but still engages the bottles and prevents unwanted motion in the carrier.

The features, benefits and objects of this invention will become clear to those skilled in the art by reference to the following description, claims and drawings.

BRIEF DESCRIPTION OF THE SEVERAL VIEWS OF THE DRAWING

FIG. 16 is a partial perspective view of the carrier of FIG. 15 showing the handle in operative condition.

FIG. 17 is a partial cross-section view taken along line 17—17 of FIG. 16.

FIG. 18 is a partial plan view of the blank for forming another alternative embodiment of the carrier.

FIG. 19 is a perspective view of the carrier formed from the blank of FIG. 18.

DETAILED DESCRIPTION

Figure 1:
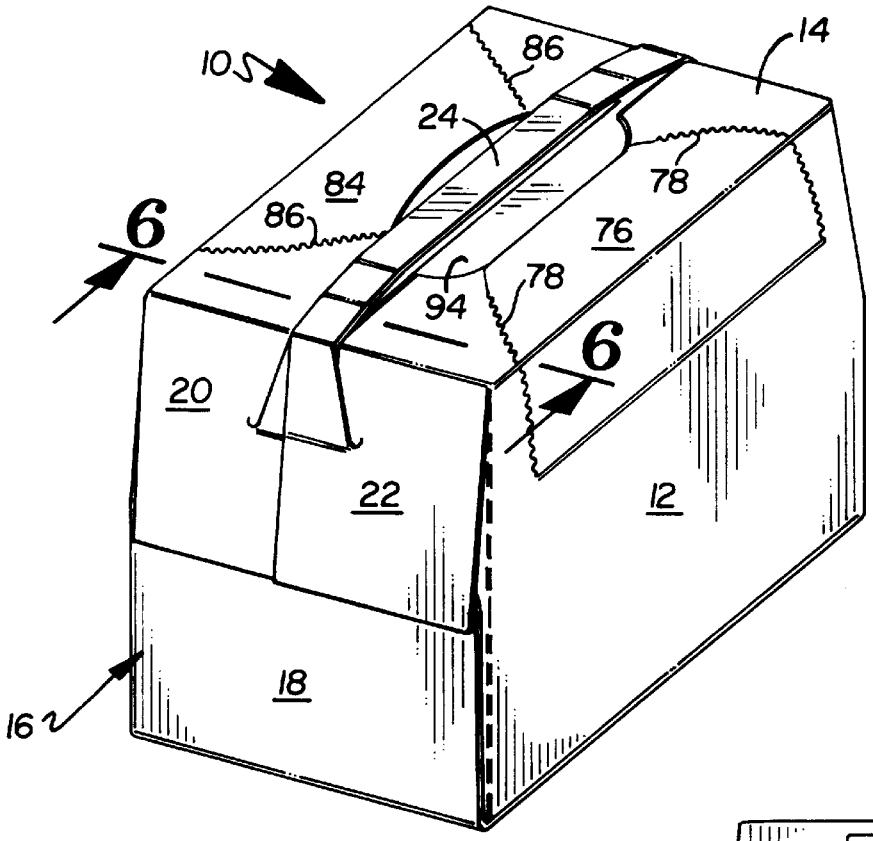
FIG. 1 is a perspective view of the carrier of the present invention.
Figure 9:
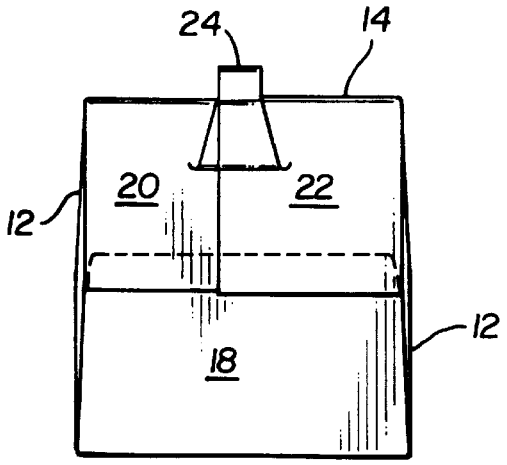
FIG. 9 is an end view of the carrier shown in FIG. 1.

Referring to FIG. 1, the carrier 10 is comprised of side panels 12 connected to top panel 14 and to a bottom panel which is hidden in this view. The carrier also includes end panels 16 formed from end panel flaps connected to the top, side and bottom panels. One lower end panel flap 18, which is connected to the bottom panel, and two upper end panel flaps 20 and 22, which are connected to the top panel 14, are visible in this view. Included in the top panel is handle 24, which extends between the end panels 16 and is of multi-ply construction as described in more detail below.

Figure 2:
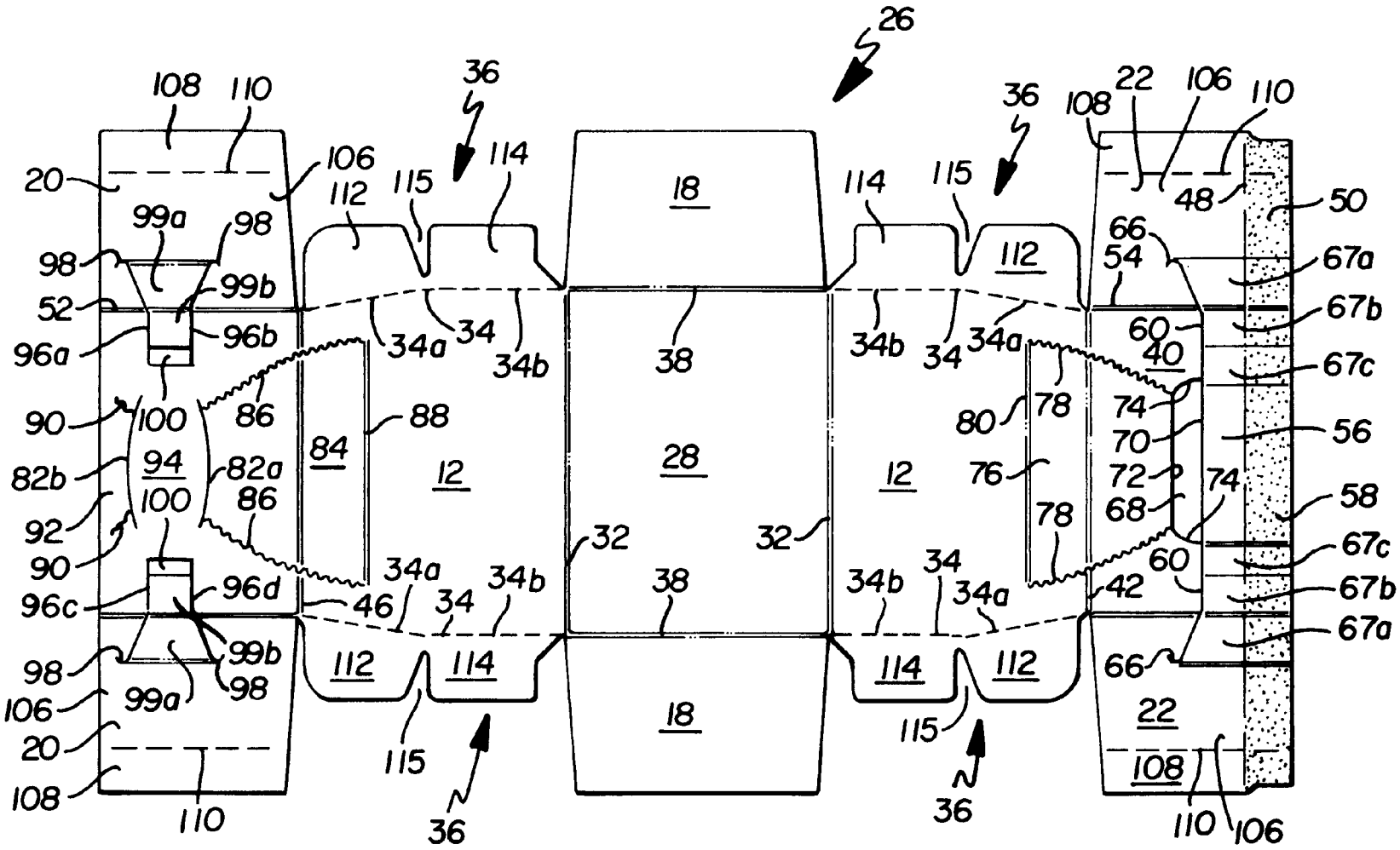
FIG. 2 is a plan view of a blank for forming the carrier of FIG. 1.

Referring to FIG. 2, a generally rectangular blank 26 from which the carrier 10 is formed is comprised of a bottom panel section 28 connected by opposite fold lines 30 and 32 to the side panel sections 12. Fold lines 34 connect the side panel sections 12 to side end panel flaps 36, while fold lines 38 connect the bottom panel section 28 to the lower end panel flaps 18. Top panel flap 40 is connected to the side panel section 12 at the right of the blank 26 by fold line 42. Another top panel flap 44 is connected to the side panel section 12 at the left of the blank 26 by fold line 46. Fold line 48 connects a reinforcement flap 50 to the top panel flap 40 and the first upper end panel flaps 22. First upper end panel flaps 22 are connected to the top panel flap 40 by fold lines 54. Similarly, second upper end panel flaps 20 are connected to the top panel flap 44 by fold lines 52. The fold lines 34, 38, 52 and 54 are aligned and form continuous fold lines.

The first top panel flap 40 and opposing first upper end panel flaps 22, as well as the reinforcement flap 50, contain means for defining a handle 24. Located in the top panel flap 40 is a handle strap 56, and similarly located in the reinforcement flap 50 is a reinforcement strap 58. Fold line 48 connects the reinforcement strap 58 to the handle strap 56. The handle strap 56 and reinforcement strap 58 are defined by a slit 60 spaced from edge 62. A central handle grip portion 64 is formed where the slit 60 is parallel to the edge 62 and normal to the fold line 54. The slit 60 extends a short distance into the upper end panel flaps 22 where it extends away from edge 62 and terminates at arcuate end portions 66. Each end of the handle strap 56 and the reinforcement strap 58 contain hinged flaps 67*a*, 67*b*, and 67*c*. Flap 67*a* is hinged to the first upper end panel flaps 22, flap 67*b* is hinged to flap 67*a*, and flap 67*c* is hinged to flap 67*b* and to the central handle grip portion 64.

The top panel flap 40 additionally includes a generally rectangular handle grip aperture 68 positioned adjacent to the central handle grip portion 64 of the handle strap 56. The handle grip aperture 68 is defined by an edge 70 of the handle strap 56, a parallel opposite edge 72, and rounded end edges 74. A stress relieving area 76 is formed by a pair of sinusoidal or serrated shaped stress relieving score lines 78 and a fold line 80. Each score line 78 gradually diverge from each other extending from the edge 72 and into the side panel 12. Each score line 78 has an overall arcuate shape with their concave side facing each other. The fold line 80 connects the ends of the score lines 78 in the side panel 12 to form a stress relieving area 76 of a generally triangular shape with an apex truncated by the handle grip aperture 68.

The top panel flap 44 has a pair of opposite, symmetrical arcuate slits 82*a* and 82*b*. A second stress relieving area 84 is formed by a pair of sinusoidal or serrated shaped stress relieving score lines 86 and a fold line 88. Each score line 86 generally diverge from each other extending from stress relieving slit 82*a* and into the side panel 12. Each score line 86 has an overall arcuate shape with their concave shape facing each other. The fold line 88 connects the ends of the score lines 86 in the side panel 12 to form a stress-relieving area 84 of a generally triangular shape with an apex truncated by slit 82*a*. Similarly, stress relieving score lines 90 extend from stress relieving slit 82*b*to form a smaller stress relieving area 92, which matches up with and is overlapped by stress relieving area 76 in a formed carrier 10.

The panel area 94 between the slits 82*a* and 82*b* is centered in the top panel 14 of the formed carrier 10 and is positioned below the handle 24. Slits 96*a* and 96*b* extend from the top panel flap 44, through fold line 52, and into the upper end panel flap 20. The slits 96*a* and 96*b* are parallel to each other and normal to the fold line 52 in the top panel flap 44 and gradually extend away from each other in the upper end panel flap 20. Slits 96*a* and 96*b* terminate at arcuate end portions 98. The slits 96*a* and 96*b* form hinged flaps 99*a* and 99*b*. Flap 99*a* is hinged to upper end panel flap 20, and flap 99*b* is hinged to flap 99*a*. An opening 100 is cut out in the top panel flap 44, and is defined by slits 96*a* and 96*b*, an edge of the top panel flap 44, and an edge of flap 98*b*. Similarly, slits 96*c* and 96*d* extend from the opposite side of the top panel flap 44, through fold line 52 and into the upper end panel flap 20 to form hinged flaps 99*a* and 99*b*.

The blank 26 forms a carrier 10 for bottles which has a narrower top portion that conforms to the shape of the bottle necks, thus allowing the carrier 10 to firmly encase the bottles. Therefore, upper end panel flaps 20 and 22 have an upper panel 106 and lower panel 108 separated by fold line 110. Additionally, the side end panel flaps 36 include an upper flap 112 and a lower flap 114 separated by a v-shaped notch 115. The fold lines 34 that connects the side end panel flaps 36 to the side panel 12 have an orthogonal portion 34*a* and a converging portion 34*b*. Lower flap 114 is hinged to the side panel 12 at the orthogonal portion 34*a* and the upper flap 112 is hinged to the side panel at the converging portion 34*b*. The v-shaped notch provides a gap that allows the upper flap 112 to fold slightly downward toward the lower flap 114.

Figure 3:
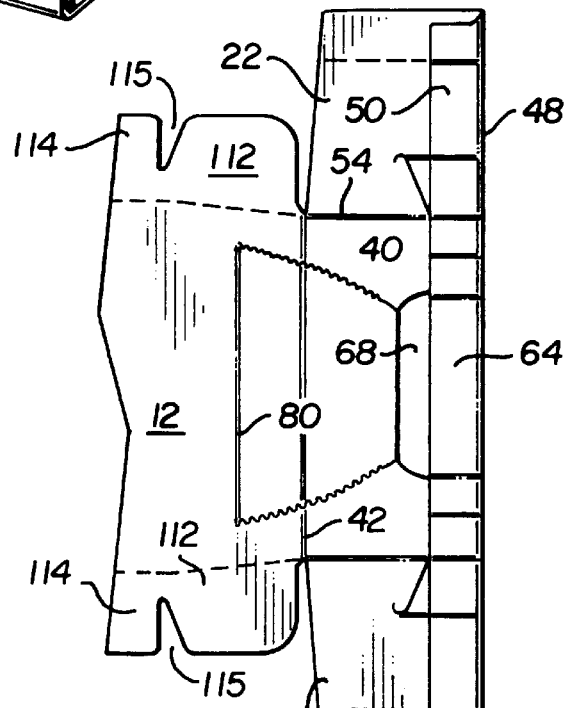
FIG. 3 is a partial plan view of the blank of FIG. 2 after an initial folding and gluing step.
Figure 5:
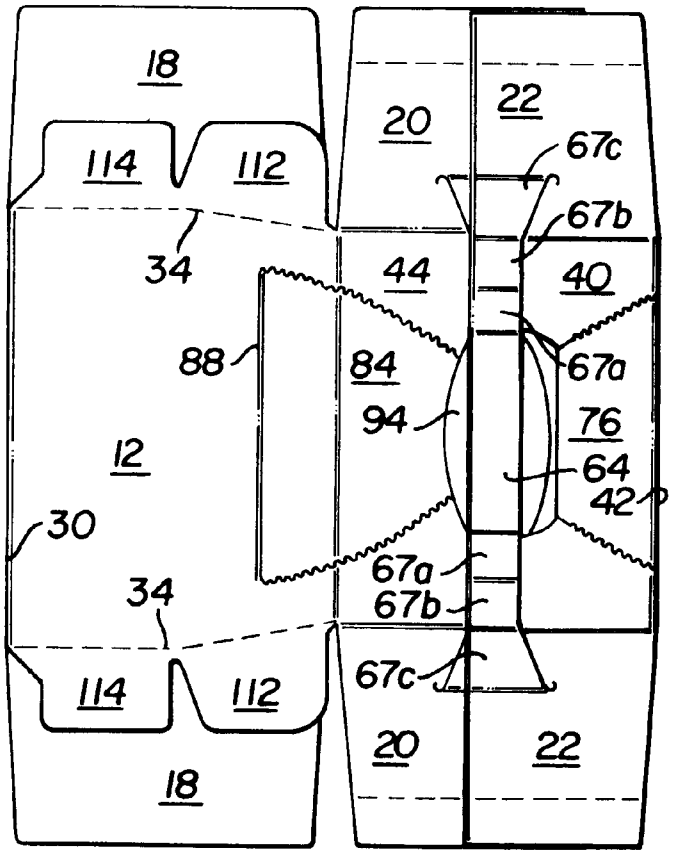
FIG. 5 is a plan view of a collapsed carrier formed as a result of a third folding step.
Figure 4:
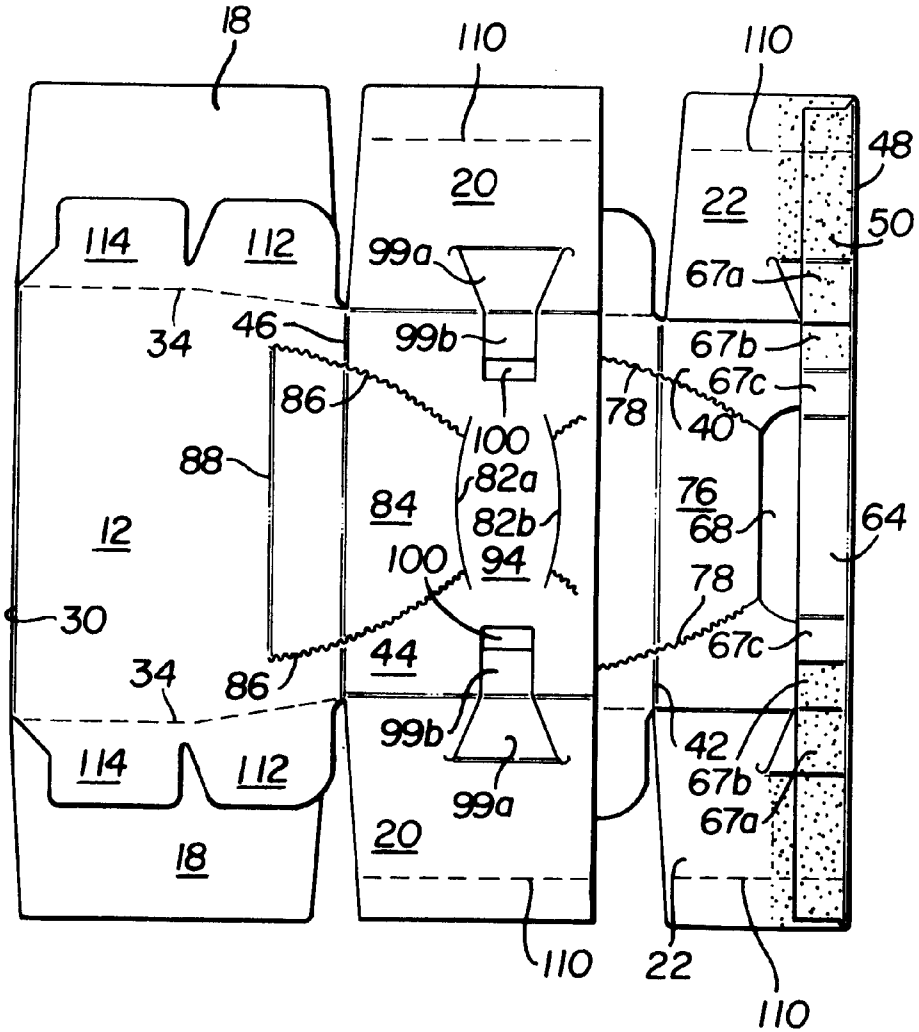
FIG. 4 is a plan view of the blank of FIG. 2 after a second folding step.

A collapsed carrier or carton sleeve 120 is formed from the blank 26 of FIG. 2 through a process shown in FIGS. 3–5. Glue is first applied to the stippled area of the reinforcement flap 58 shown in FIG. 2, and the reinforcement strap 58 is folded about fold line 48 and adhered to the handle strap 56 as shown in FIG. 3. The side panel 12 at the left of the blank 26 and the connected top panel flap 44 are then pivoted as a unit about fold line 30 to form the interim configuration shown in FIG. 4. The final step is to apply glue to the stippled area of the reinforcement strap 58 shown in FIG. 4 and fold the top panel flap 40 about fold line 42. This causes the reinforcement strap 58 to overly the panel area 94, the hinged flaps 99*a* and 99*b*, and a portion of the upper end panel flaps 20, adhering the upper end panel flaps 22 to the upper end panel flaps 20, the hinged flaps 67*a* to the hinged flaps 99*a*, and the hinged flaps 67*b* to the hinged flaps 99*b*. The result is the flattened tube or collapsed carrier of FIG. 5. The flaps and panels are folded more easily if double score lines are used. Double score lines are particularly beneficial along fold line 48 between the reinforcement flap 58 and the handle strap 56.

Figure 6:
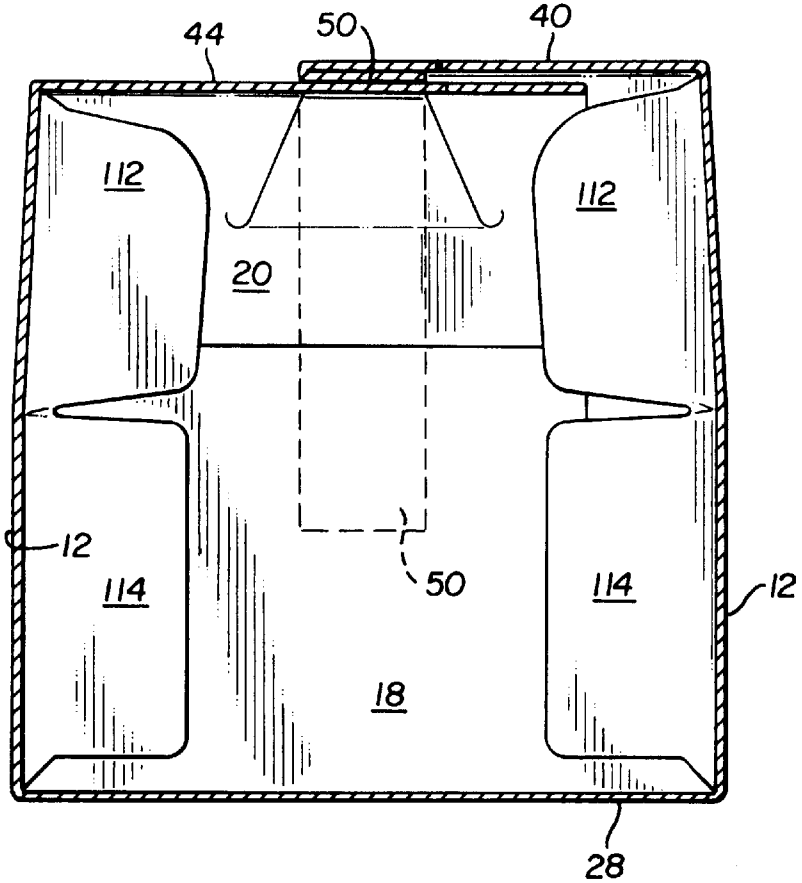
FIG. 6 is a partial cross-sectional view along line 6—6 of FIG. 1.
Figure 10:
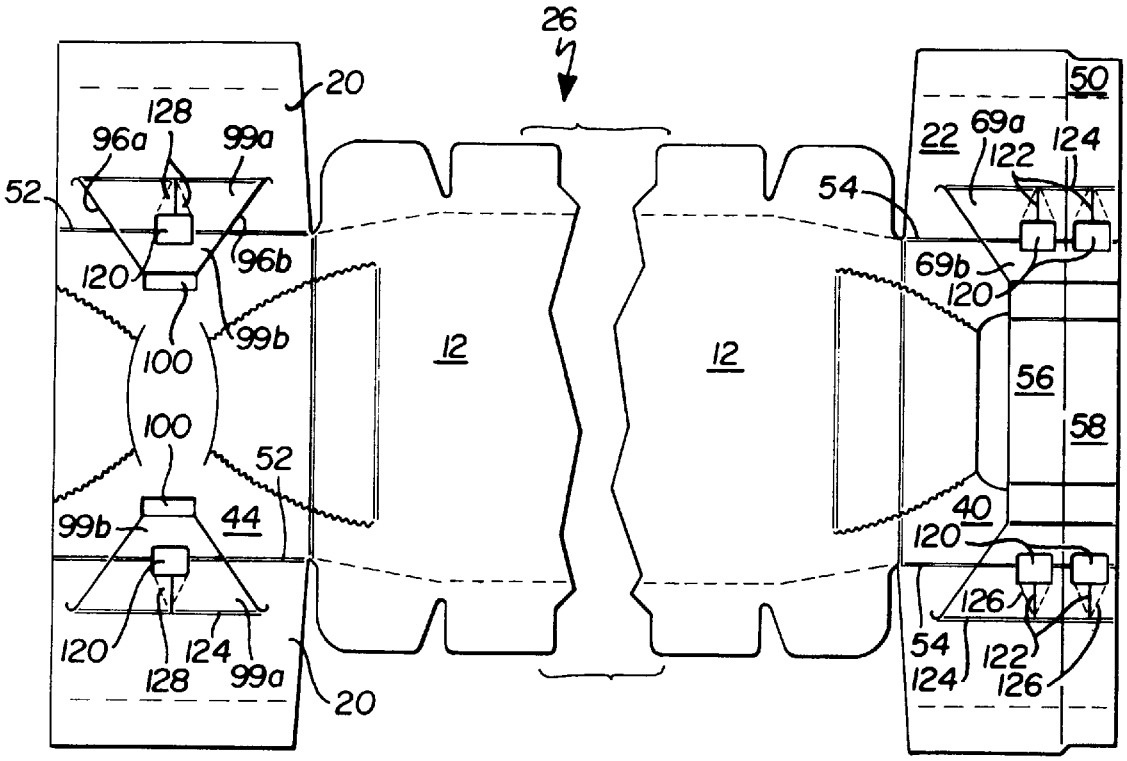
FIG. 10 is a partial plan view of the blank for forming an alternative embodiment of the carrier.

Typically, collapsed carriers are shipped to a packaging facility where they are erected, loaded with the articles being packaged which is in this case bottles, and their ends closed by means well known in the industry to form the finished carrier of FIG. 1. FIG. 6 shows a cross section along line 6—6 of FIG. 1 to illustrate the complete construction of the carrier 10. The upper flaps 112 and lower flaps 114 are folded first, then the lower end panel flaps 18, and then the upper end panel flaps 20 and 22 which have been previously adhered together. The tops of the side panels 12 are seen to bend inward as the carton conforms to the contoured shape of the bottles, and the angle of the gap between the upper and lower flaps 112 and 114 has become smaller.

Figure 7:
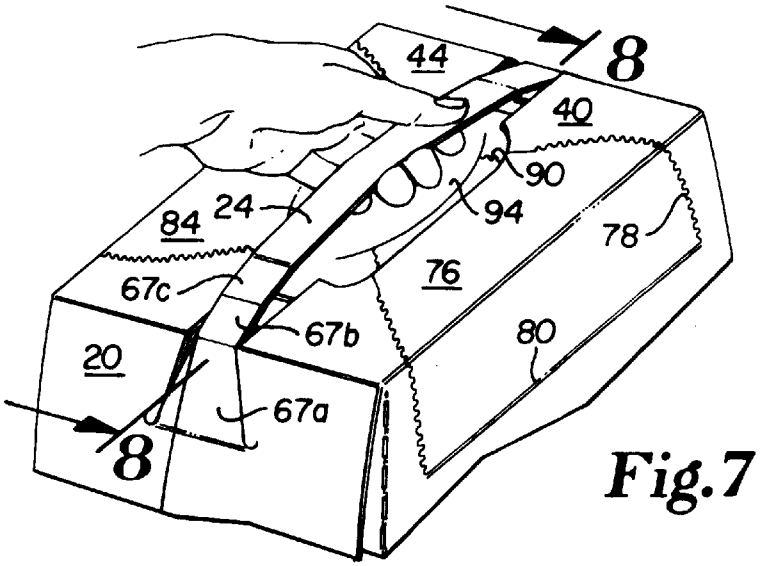
FIG. 7 is a partial perspective view of the carrier of FIG. 1 showing the handle in operative condition.
Figure 8:
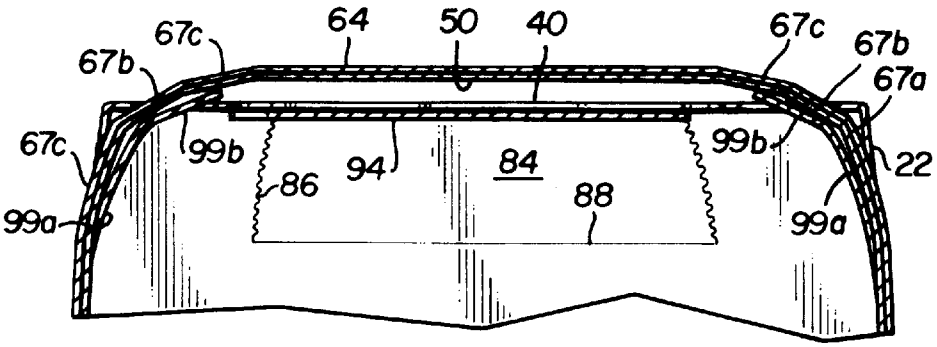
FIG. 8 is a partial cross-sectional view taken along line 8—8 of FIG. 7.

As shown in FIGS. 1 and 7, the two-ply handle 24 is exterior to the top panel 14. The panel area 94 below the handle 24 prevents a user's fingers from contacting and becoming abraded by the crown closures on the bottles. The weight of the carrier 10 causes the handle 24 to bow upwardly when a user lifts the carrier 10 by the handle 24. The hinged flaps 67*a*, 67*b* and 67*c* move to accommodate the vertical motion of the handle 24.

The result is a strong two-ply handle that extends from one end of the carrier to the other, thus distributing lifting stresses to the relatively strong end panels rather than to the top panel. The reinforcement strap 50 also provides the end panels with a two-ply construction along the first upper end panel flap 22 which further increases the strength of the end panels. Additionally, the arcuate end 66 of the slits 60 prevent tearing of the upper end panel flap. Further, there is little or no risk of tearing at the edge of the strap, and the stress relieving scores alleviate the risk of the top panels 14 and side panels 12 from tearing when the carrier is lifted.

Figure 11:
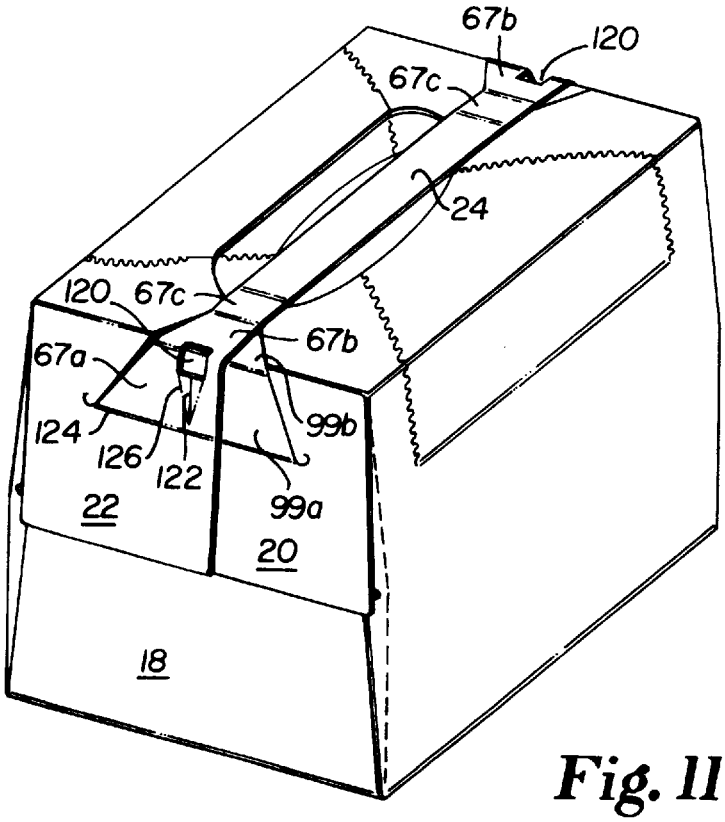
FIG. 11 is a perspective view of the carrier formed from the blank of FIG. 10.
Figure 14:
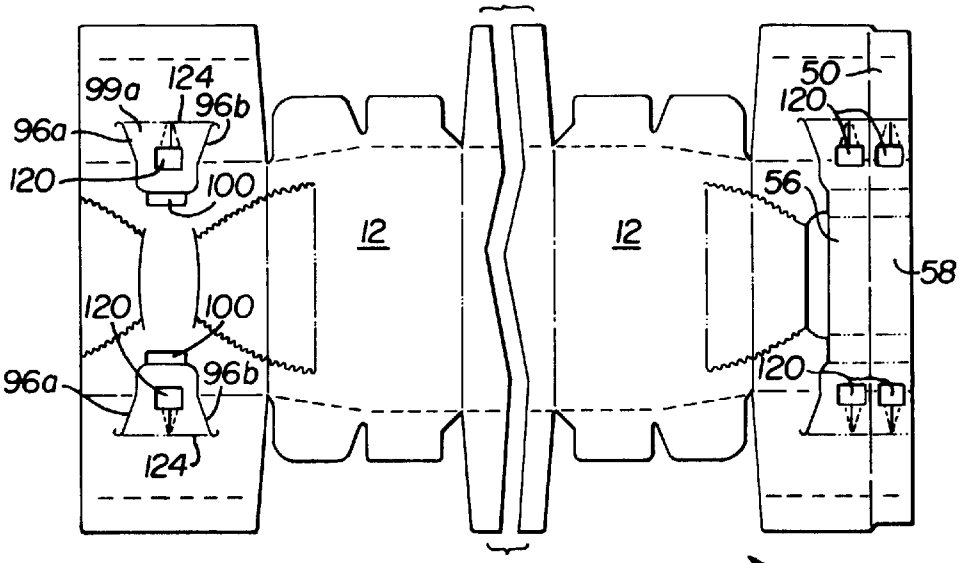
FIG. 14 is a partial plan view of the blank for forming another alternative embodiment of the carrier.
Figure 15:
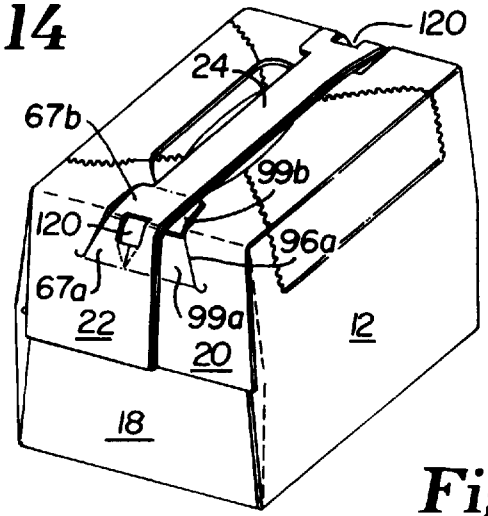
FIG. 15 is a perspective view of the carrier formed from the blank of FIG. 14.
Figure 12:
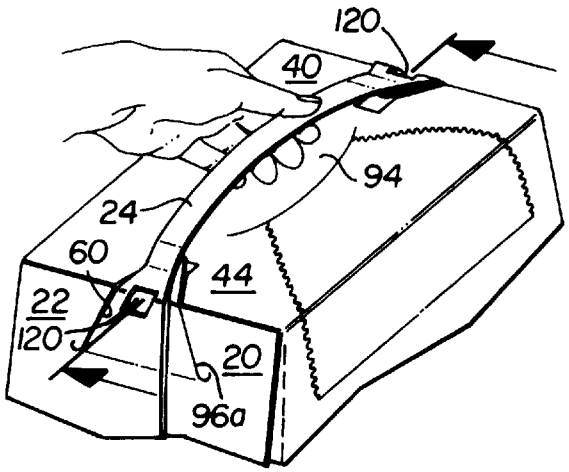
FIG. 12 is a partial perspective view of the carrier of FIG. 11 showing the handle in operative condition.
Figure 13:
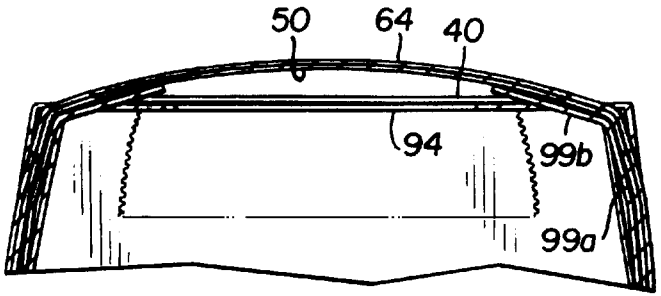
FIG. 13 is a partial cross-sectional view taken along line 13—13 of FIG. 12.
Figure 22:
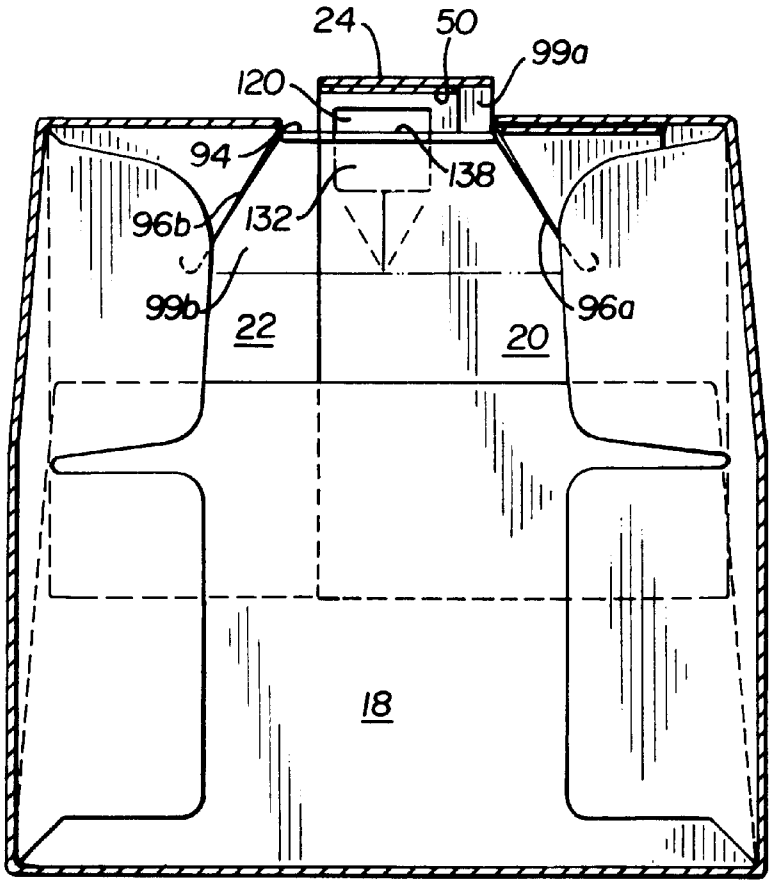
FIG. 22 is a cross-sectional view taken along line 22—22 of FIG. 19.
Figure 20:
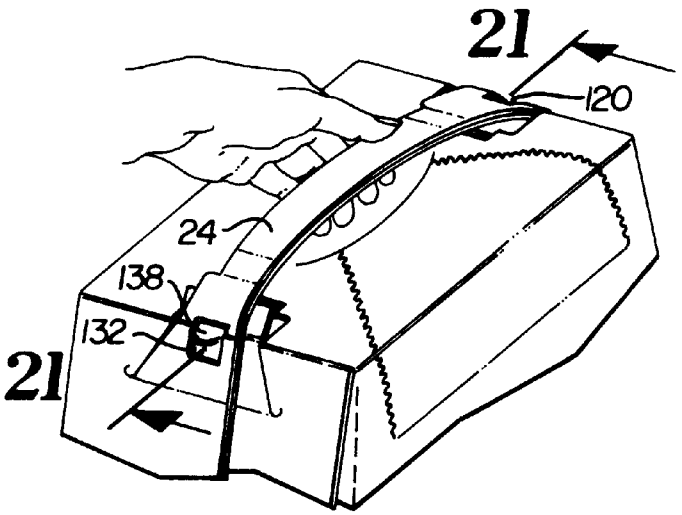
FIG. 20 is a partial perspective view of the carrier of FIG. 19 showing the handle in operative condition.
Figure 21:
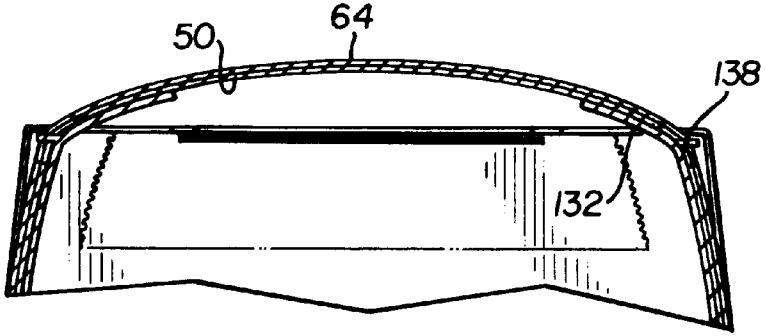
FIG. 21 is a partial cross-section view taken along line 21—21 of FIG. 20.

FIGS. 10–13 illustrate a second embodiment of the carrier. Referring to the blank 26 shown in FIG. 11, notches 120 are cut into the ends of the handle 24 of the second embodiment. When the carrier is lifted, the bottles have a tendency to have their heel portion pivot toward the outside and their neck portion pivot toward the inside. The notches 120 engage the underside of the finish portion or crown portion of the end bottles of the center row of a group of bottles, which helps prevent the bottles from moving when the carrier is lifted. The blank 26 of the second embodiment is similar to that of the first embodiment. The differences lie in the design of the handle 24. Generally square notches 120 are cut at each end of the reinforcement strap 58 and the handle strap 56. A major portion of the notches lie in hinged flap 69*a*, and a smaller portion extends over fold line 54 into hinged flap 69*b*. Similarly, a major portion of a notch 120 lies in each upper end panel flap 20 and a smaller portion extends over fold line 52 into the top panel flap 44. These notches 120 align with each other when the blank 26 is folded into a compressed carrier, to ultimately form the two notches 120 located at each end of the handle 24 as shown in FIG. 11. A vertical slit 122 extends from each notch 120 in the blank 26 to fold line 124. Additionally, two stress relieving score lines 126 extend from the fold line to each notch 120. The score lines 126 intersect with the slit 122 at the fold line 124 and extend to a corner of the generally square notch 120. The notch 120, slit 122 and score lines 126 form triangular shaped panels 128 which can snugly receive the top of the bottles. Compared to the first embodiment, the top panel flap 44 of the second embodiment has wider openings 100. Additionally, the slits 96*a* and 96*b* begin to extend away from each other at the opening 100. The slits 96*a* and 96*b*, in conjunction with the opening 100 and the fold line 124, define a generally triangular tapered panel comprised of the hinged flaps 99*a* and 99*b*. The notch 120 may weaken the structural integrity of the hinged flaps 99*a* and 99*b* by removing a portion of the fold line 52. The modified design maintains the structural integrity of the hinged flaps 99*a* and 99*b* by increasing the width of the hinged flaps on each side of the notch 120.

FIGS. 14–17 illustrate a third embodiment of the carrier. It is similar to the second embodiment, with the exception that the slits 96*a* and 96*b* have a different configuration to form a bell-shaped tapered portion comprised of hinged flaps 99*a* and 99*b*. This design has also been found to maintain the structural integrity of the carrier when notches 120 are cut into the handle 24.

FIGS. 18–22 illustrate a fourth embodiment of the carrier. The fourth embodiment is similar to the third embodiment, but differs in so far as opaque sections or panels 132 are substituted for the notches 120 in the upper end panel flaps 20. The opaque panels 132 have the same generally square shape as the notch 120. However, rather than being cut out, the generally square opaque panel 132 is defined by two vertical slits 134 and two horizontal score lines 136. Additionally, an arcuate score line 138 is positioned concave upward in the general center of the opaque section 132. When the opaque panel 132 contacts a bottle top when the handle 24 is lifted, the opaque panel 132 will hinge at the horizontal score lines 136, and will further bend on the top edge of the bottle at the arcuate score line 138. The opaque panel 132 prevents light from contacting bottles of beer within the carrier 10. The slits 96*a* and 96*b* of the fourth embodiment form the generally bell-shaped tapered panel described in the second embodiment.

Figure 23:
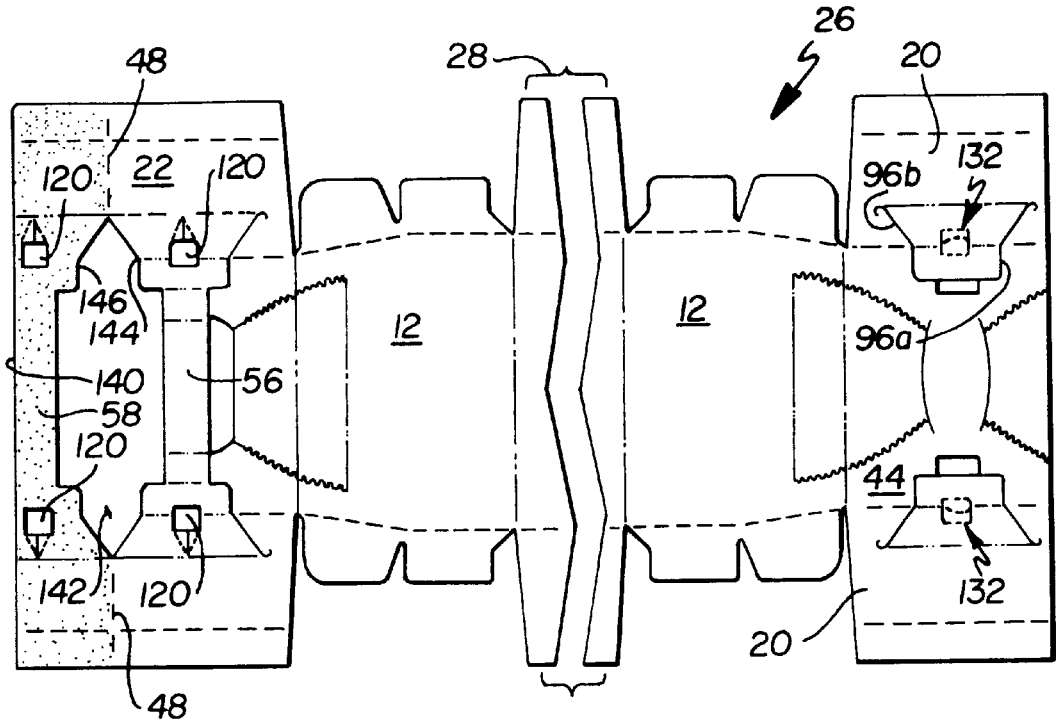
FIG. 23 is a partial plan view of the blank for forming another alternative embodiment of the carrier.
Figure 24:
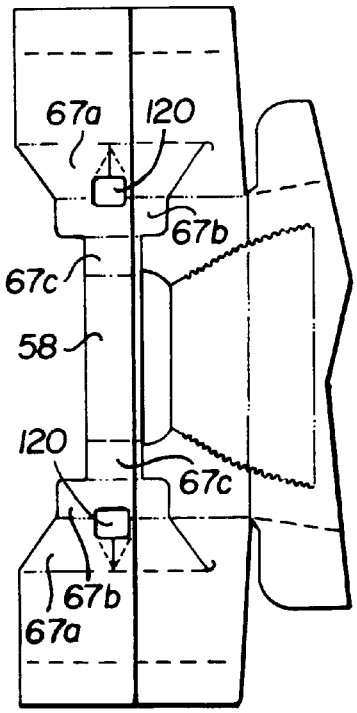
FIG. 24 is a partial plan view of the blank of FIG. 23 after an initial folding and gluing step.
Figure 25:
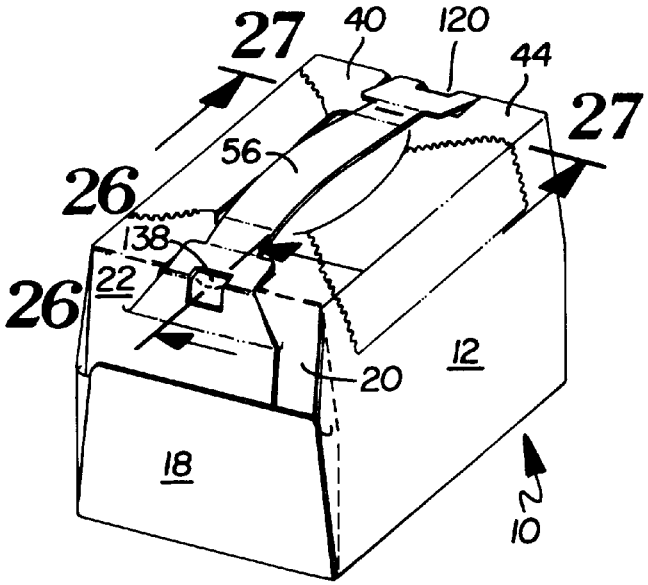
FIG. 25 is a perspective view of the carrier formed from the blank of FIG. 23.
Figure 26:
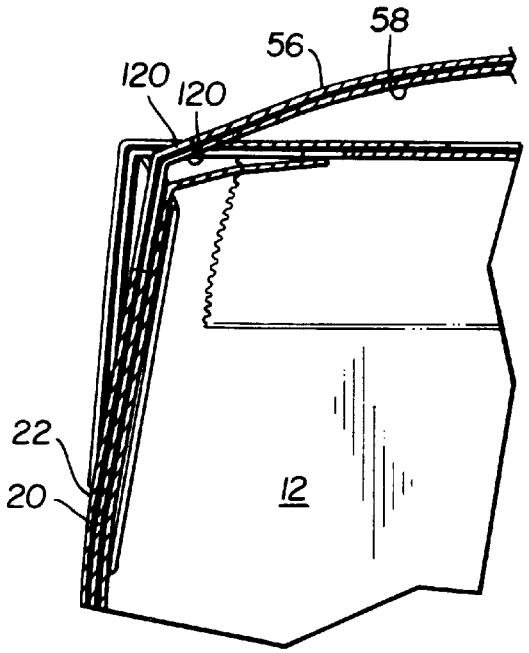
FIG. 26 is partial cross-sectional view taken along line 26—26 of FIG. 25.
Figure 27:
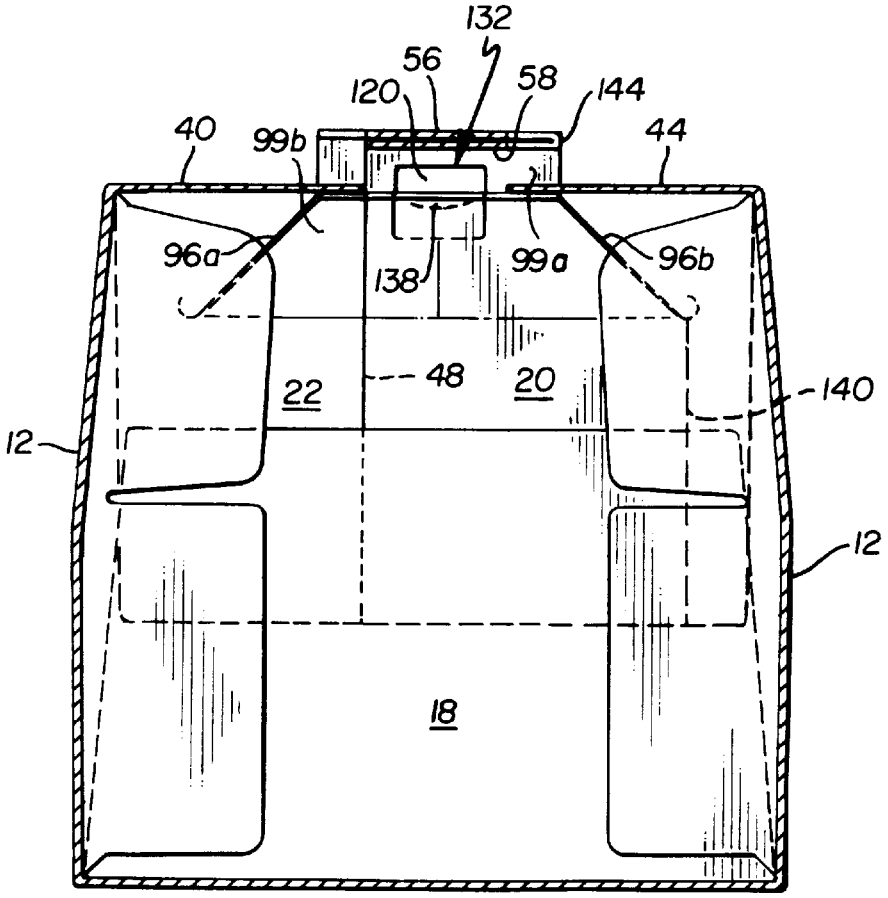
FIG. 27 is a cross-sectional view taken along line 17—17 of FIG. 25.

FIGS. 23–27 illustrate a fifth embodiment of the carrier. The fifth embodiment combines the configuration of slits 96*a* and 96*b* that form a generally bell-shaped tapered panel as shown in the third embodiment, and the opaque panel 132 shown in the fourth embodiment. As shown in FIG. 23, a major difference in the fifth embodiment is the modified reinforcement flap 140 that is wider than the reinforcement strap 50 shown in FIG. 2. The modified reinforcement flap 140 provides additional strength to the end panels 16 of the carrier 10 by reinforcing a wider area along the edge of the upper end panel flap 22 and by increasing the overlapping area of the upper end panel flaps 22 on the upper end panel flaps 20. The blank 26 shown in FIG. 23 has an opening 142 formed between the modified reinforcement flap 140 and the handle strap 56, which are symmetrical about fold lines 48. Edges 144 and 146 align with slit 96*a* in the top panel flap 44 in a carrier 10 formed from the blank 26. As shown in FIG. 24, the modified flap 140 is folded over on handle strap 56. The increased width of the upper end panel flap 22 is seen in FIG. 25.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims. Where a claim, if any, is expressed as a means or step for performing a specified function it is intended that such claim be construed to cover the corresponding structure, material, or acts described in the specification and equivalents thereof, including both structural equivalents and equivalent structures, material-based equivalents and equivalent materials, and act-based equivalents and equivalent acts.

What is claimed is:

1. A blank for forming an article carrier, comprising:

(a) a bottom panel section connected by fold lines to opposite first and second side panel sections;

(b) said first side panel section being connected by a fold line to a first top panel flap and said second side panel section being connected by a fold line to a second top panel flap;

(c) opposing side end panel flaps connected by fold lines to opposite ends of said first and second side panel sections, lower end panel flaps connected by fold lines to opposite ends of said bottom panel section, opposing first upper end panel flaps connected by fold lines to opposite ends of said first top panel flaps, and opposing second upper end panel flaps connected by fold lines to opposite ends of said second top panel flaps;

(d) means for defining a handle strap in said first top panel flap and said first upper end panel flaps, said handle strap having opposite ends, said handle strap spanning across said first top panel flap, said handle strap ends being connected to said first upper end panel flaps, said means for defining a handle strap including a central handle portion and at least one hinged flap at each end thereof; and (e) said first top panel flap and said second top panel flap having dimensions that allow both said handle strap and at least a portion of said first top panel flap to overlap at least a portion of said second top panel flap in a carrier formed from said blank, said first top panel flap and said second top panel flap forming a top panel in said carrier, said handle strap extending above said top panel, and said second top panel flap and said opposing second upper end panel flaps including opposing sets of at least one hinged flap adhered to said at least one hinged flap at each of said handle strap ends in a carrier formed from said blank.

2. The blank of claim 1, wherein a first stress relieving area extends from said first top panel flap to said first side panel section and a second stress relieving area extends from said second top panel flap to said second side panel section.

3. The blank of claim 2, wherein said first and second stress relieving areas have a generally triangular shape defined by a truncated apex, opposing sides and a base.

4. The blank of claim 3, wherein said opposing sides are sinusoidal score lines and said base is a fold line.

5. The blank of claim 3, wherein said first top panel flap has a handle grip aperture that forms said truncated apex of said first stress relieving area.

6. The blank of claim 3, wherein said second top panel flap has a slit that forms said truncated apex of said second stress relieving area.

7. The blank of claim 1, wherein each of said fold lines connecting said side end panel flaps to said side panel sections have an orthogonal portion and a converging portion for conforming said carrier to the contour of a group of bottles, said side end panel flaps including an upper flap and a lower flap, said upper flap being hinged to said side panel section at said converging portion and said lower flap being hinged to said side panel at said orthogonal portion.

8. The blank of claim 1, wherein said first top panel flap has a handle grip aperture and a first and second handle-defining slit extending from said handle grip aperture and into said opposing first upper end panel flaps, said handle grip aperture and said first and second handle defining slits providing said means for defining a handle strap, said opposite ends of said handle strap being hinged to said opposite first upper end panel flaps.

9. The blank of claim 1, wherein said central handle portion is positioned over a panel area on said second top panel flap in a carrier formed from said blank.

10. The blank of claim 1, further comprising a reinforcement flap connected by a fold line to said first top panel flap, said means for defining a handle, and said opposing first upper end panel flaps.

11. The blank of claim 10, wherein said fold line connecting said reinforcement flap to said first top panel flap is aligned with an edge of said handle strap.

12. The blank of claim 10, wherein said fold line connecting said reinforcement flap to said first top panel flap is spaced away from said handle strap.

13. The blank of claim 10, wherein said reinforcement flap folds under and is adhered to said handle strap and said opposing first upper end panel flaps, said reinforcement flap and said handle strap forming a two-ply handle in a carrier formed from said blank, said handle extending above a top panel in said carrier and having opposite ends connected to opposing end panels in said carrier.

14. The blank of claim 13, wherein said fold line connecting said reinforcement flap to said first top panel flap is double scored.

15. The blank of claim 1, wherein each of said handle strap ends has a notch for engaging the tops of bottles within said carrier.

16. The blank of claim 15, wherein said means for defining a handle strap includes a central handle portion and at least one hinged flap at each end thereof, said at least one hinged flap forming a generally triangular-shaped region containing said notch.

17. The blank of claim 15, wherein said means for defining a handle strap includes a central handle portion and at least one hinged flap at each end thereof, said at least one hinged flap forming a generally bell-shaped region containing said notch.

18. The blank of claim 15, wherein said second top panel flap and said opposing second upper end panel flaps include opposing sets of at least one hinged flap adhered to said at least one hinged flap at each of said handle strap ends in a carrier formed from said blank, said notch containing an opaque panel formed in said opposing sets of at least one hinged flap formed in said second top panel flap and said opposing second upper end panel flaps, said opaque panel having scores for engaging the tops of the bottles.

19. The blank of claim 18, wherein said opposing sets of at least one hinged flap formed in said second top panel flap and said opposing second end panel flaps form a generally triangular-shaped region containing said notch.

20. The blank of claim 18, wherein opposing sets of at least one hinged flap formed in said second top panel flap and said opposing second end panel flaps form a generally bell-shaped region containing said notch.

21. A blank for forming an article carrier, comprising:

(a) a bottom panel section connected by fold lines to opposite first and second side panel sections;

(b) said first side panel section being connected by a fold line to a first top panel flap and said second side panel section being connected by a fold line to a second top panel flap;

(c) opposing side end panel flaps connected by fold lines to opposite ends of said first and second side panel sections, lower end panel flaps connected by fold lines to opposite ends of said bottom panel section, opposing first upper end panel flaps connected by fold lines to opposite ends of said first top panel flaps, and opposing second upper end panel flaps connected by fold lines to opposite ends of said second top panel flaps;

(d) means for defining a handle strap in said first top panel flap and said first upper end panel flaps, said handle strap having opposite ends, said handle strap spanning across said first top panel flap, said handle strap ends being connected to said first upper end panel flaps, said means for defining a handle strap including a central handle portion and at least one hinged flap at each end thereof, said central handle being positioned over a panel area on said second top panel flap in a carrier formed from said blank, said second top panel flap and said opposing second upper end panel flaps including opposing sets of at least one hinged flap adhered to said at least one hinged flap at each of said handle strap ends in said carrier formed from said blank;

(e) a reinforcement flap connected by a fold line to said first top panel flap, said means for defining a handle, and said opposing first upper end panel flaps, said reinforcement flap folding under and adhering to said handle strap and said opposing first upper end panel flaps, said reinforcement flap and said handle strap forming a two ply handle in said carrier formed from said blank, said handle having opposite ends connected to opposing end panels in said carrier; and (f) said first top panel flap and said second top panel flap having dimensions that allow both said handle strap and at least a portion of said first top panel flap to overlap at least a portion of said second top panel flap in a carrier formed from said blank, said first top panel flap and said second top panel flap forming a top panel in said carrier, said handle strap extending above said top panel.

22. A blank for forming an article carrier, comprising:

(a) a bottom panel section connected by fold lines to opposite first and second side panel sections;

(b) said first side panel section being connected by a fold line to a first top panel flap and said second side panel section being connected by a fold line to a second top panel flap;

(c) opposing side end panel flaps connected by fold lines to opposite ends of said first and second side panel sections, lower end panel flaps connected by fold lines to opposite ends of said bottom panel section, opposing first upper end panel flaps connected by fold lines to opposite ends of said first top panel flaps, and opposing second upper end panel flaps connected by fold lines to opposite ends of said second top panel flaps, said fold lines connecting said opposing side end panel flaps to said side panel sections having an orthogonal portion and a converging portion for conforming to the contour of a group of bottles, said side end panel flaps including an upper flap and a lower flap, said upper flap being hinged to said side panel section at said converging portion and said lower flap being hinged to said side panel at said orthogonal portion;

(d) means for defining a handle strap in said first top panel flap and said first upper end panel flaps, said handle strap having opposite ends, said handle strap spanning across said first top panel flap, said handle strap ends being connected to said first upper end panel flaps, said means for defining a handle strap including a central handle portion and at least one hinged flap at each end thereof, said central handle being positioned over a panel area on said second top panel flap in a carrier formed from said blank, said second top panel flap and said opposing second upper end panel flaps including opposing sets of at least one hinged flap adhered to said at least one hinged flap at each of said handle strap ends in said carrier formed from said blank, said first top panel flap having a handle grip aperture and a first and second handle-defining slit extending from said handle grip aperture and into said opposing first upper end panel flaps, said handle grip aperture and said first and second handle defining slits providing said means for defining a handle strap, said opposite ends of said handle strap being hinged to said opposite first upper end panel flaps, each of said handle strap ends having a notch for engaging the tops of bottles within said carrier formed by said blank;

(e) a reinforcement flap connected by a fold line to said first top panel flap, said means for defining a handle, and said opposing first upper end panel flaps, said reinforcement flap folding under and adhering to said handle strap and said opposing first upper end panel flaps, said reinforcement flap and said handle strap forming a two ply handle in said carrier formed from said blank, said handle having opposite ends connected to opposing end panels in said carrier; and (f) said first top panel flap and said second top panel flap having dimensions that allow both said handle strap and at least a portion of said first top panel flap to overlap at least a portion of said second top panel flap in a carrier formed from said blank, said first top panel flap and said second top panel flap forming a top panel in said carrier, said handle strap extending above said top panel.

23. An article carrier, comprising:

(a) a first side panel and an opposite second side panel connected to a top panel, a bottom panel, a first end panel, and an opposite second end panel;

(b) said top panel being comprised of a first top panel flap foldably connected to said first side panel, and second top panel flap foldably connected to said second side panel;

(c) at least a portion of said first top panel flap overlapping and being adhered to at least a portion of said second top panel flap;

(d) opposing first upper end panel flaps connected by a fold line to opposite ends of said first top panel flaps, and opposing second upper end panel flaps connected by a fold line to opposite ends of said second top panel flaps;

(e) means for defining a handle strap in said first top panel flap, said handle strap having opposite ends, each of said handle strap ends having a notch for engaging the tops of bottles, said handle strap spanning across said first top panel flap, said handle strap ends being connected to said first upper end panel flaps, said means for defining a handle strap permitting said handle strap to be raised above said top panel; and (f) said handle strap overlying said second top panel flap.

24. The article carrier of claim 23, wherein a reinforcement flap is connected by a fold line to said first top panel flap and said opposing first upper end panel flaps to form a two-ply handle strap.

25. The article carrier of claim 24, wherein said fold line connecting said reinforcement flap to said first top panel flap is aligned with an edge of said two-ply handle strap.

26. The article carrier of claim 24, wherein said fold line connecting said reinforcement flap to said first top panel flap is spaced away from said two-play handle strap.

27. The article carrier of claim 23, wherein said notch contains an opaque panel, said opaque panel having a scores and slits to engage the top of bottles.

28. The article carrier of claim 23, wherein each of said handle strap ends has at least one hinged flap.

29. The article carrier of claim 28, wherein said hinged flaps form a triangular region containing the notch for engaging the tops of bottles.

30. The article carrier of claim 28, wherein said hinged flaps form a bell-shaped region containing the notch for engaging the tops of bottles.

31. An article carrier, comprising:

(a) a first side panel and an opposite second side panel connected to a top panel, a bottom panel, a first end panel, and an opposite second end panel;

(b) said top panel being comprised of a first top panel flap foldably connected to said first side panel, and second top panel flap foldably connected to said second side panel;

(c) at least a portion of said first top panel flap overlapping and being adhered to at least a portion of said second top panel flap;

(d) opposing first upper end panel flaps connected by a fold line to opposite ends of said first top panel flaps, and opposing second upper end panel flaps connected by a fold line to opposite ends of said second top panel flaps;

(e) means for defining a handle strap in said first top panel flap, said handle strap having opposite ends, said handle strap spanning across said first top panel flap, said handle strap ends being connected to said first upper end panel flaps, said means for defining a handle strap permitting said handle strap to be raised above said top panel, each of said handle strap ends having at least one hinged flap;

(f) a reinforcement flap being connected by a fold line to said first top panel and said opposing first upper end panel flaps to form a two-ply handle strap; and (g) said handle strap overlying said second top panel flap.

32. A blank for forming an article carrier, comprising:

(a) a bottom panel section connected by fold lines to opposite first and second side panel sections;

(b) said first side panel section being connected by a fold line to a first top panel flap and said second side panel section being connected by a fold line to a second top panel flap;

(c) opposing side end panel flaps connected by fold lines to opposite ends of said first and second side panel sections, lower end panel flaps connected by fold lines to opposite ends of said bottom panel section, opposing first upper end panel flaps connected by fold lines to opposite ends of said first top panel flaps, and opposing second upper end panel flaps connected by fold lines to opposite ends of said second top panel flaps;

(d) means for defining a handle strap in said first top panel flap and said first upper end panel flaps, said handle strap having opposite ends, each of said handle strap ends having a notch for engaging the tops of bottles within said carrier, said handle strap spanning across said first top panel flap, said handle strap ends being connected to said first upper end panel flaps; and (e) said first top panel flap and said second top panel flap having dimensions that allow both said handle strap and at least a portion of said first top panel flap to overlap at least a portion of said second top panel flap in a carrier formed from said blank, said first top panel flap and said second top panel flap forming a top panel in said carrier, said handle strap extending above said top panel.

33. An article carrier, comprising:

(a) a first side panel and an opposite second side panel connected to a top panel, a bottom panel, a first end panel, and an opposite second end panel, (b) said top panel being comprised of a first top panel flap foldably connected to said first side panel, and second top panel flap foldably connected to said second side panel;

(c) at least a portion of said first top panel flap overlapping and being adhered to at least a portion of said second top panel flap;

(d) opposing first upper end panel flaps connected by a fold line to opposite ends of said first top panel flaps, and opposing second upper end panel flaps connected by a fold line to opposite ends of said second top panel flaps;

(e) means for defining a handle strap in said first top panel flap, said handle strap having opposite ends, each of said handle strap ends having at least one hinged flap, said handle strap spanning across said first top panel flap, said handle strap ends being connected to said first upper end panel flaps, said means for defining a handle strap permitting said handle strap to be raised above said top panel; and (f) said handle strap overlying said second top panel flap.

* * * * *